United States Patent [19]

Luyckx

[11] Patent Number: 4,667,939

[45] Date of Patent: May 26, 1987

[54] PURIFYING STEEL

[75] Inventor: Leon A. Luyckx, Strongsville, Ohio

[73] Assignee: Foseco International Limited, Birmingham, England

[21] Appl. No.: 844,163

[22] Filed: Mar. 26, 1986

[51] Int. Cl.[4] ..... C21C 5/48

[52] U.S. Cl. ..... 266/287; 75/59.26; 266/218; 266/220; 266/280

[58] Field of Search ..... 75/61, 63, 65, 59.26, 75/59.11; 266/287, 280, 220, 265

[56] References Cited

U.S. PATENT DOCUMENTS

| | | | |
|---|---|---|---|
| 2,843,473 | 7/1958 | Colbry | 75/63 |
| 3,393,998 | 7/1968 | Lambert | 75/63 |
| 3,528,799 | 9/1970 | Ramacciotti | 75/59.11 |
| 3,734,718 | 5/1973 | Bradshaw | 75/63 |
| 3,817,502 | 6/1974 | Taylor | 75/59.11 |
| 4,386,956 | 6/1983 | Roth | 75/63 |

FOREIGN PATENT DOCUMENTS

| | | | |
|---|---|---|---|
| 1180532 | 6/1985 | Canada | 266/287 |

*Primary Examiner*—Peter D. Rosenberg
*Attorney, Agent, or Firm*—Nixon & Vanderhye

[57] ABSTRACT

A method of purifying steel in a tundish, especially to remove alumina inclusions, comprises passing the steel through at least one refractory board having apertures through it and introducing inert gas into the steel at the upstream side of the foot of the board to cause a stream of bubbles to flow over the upstream side of the board. One of the boards may comprise a ceramic filter element. The boards may be non-vertical and have integral gas supply means. The apertures may taper, may have axes angled from perpendicular to the board's plane and may have high alumina content surfaces. The upstream side of the board may have an exothermic layer.

20 Claims, 5 Drawing Figures

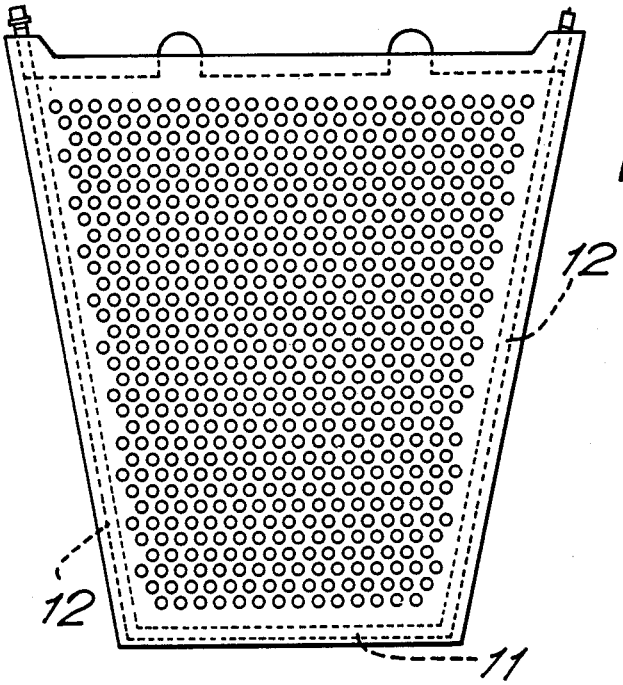
FIG. 3.
FIG. 4.
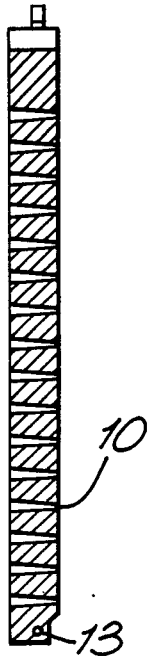
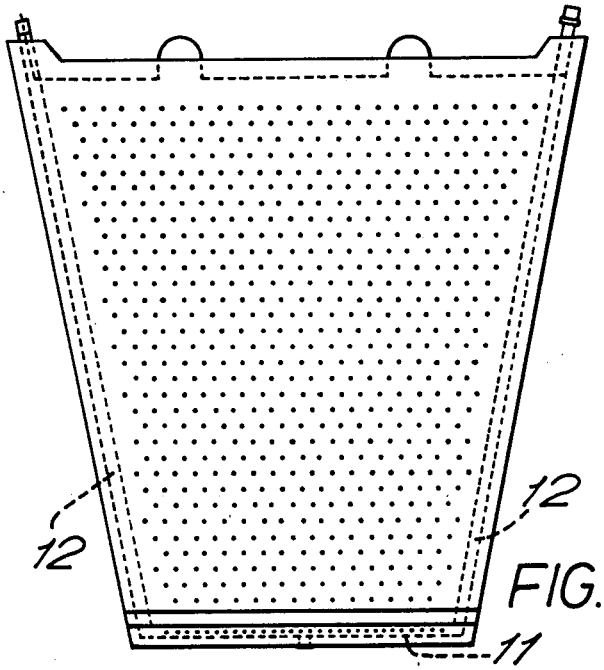
FIG. 5.

PURIFYING STEEL

The invention relates to purifying steel and articles and apparatus of use in purifying steel, particularly in the case of continuous casting of steel.

In the continuous casting of steel, molten metal is poured from a ladle into a continuous casting mould via an intermediate vessel (a tundish) which acts as a constant head reservoir.

It is usual to treat the steel as initially produced at a stage before it is in the ladle and/or whilst it is in the ladle in order to remove undesired impurities. However, a proportion of impurities, especially solid impurities or 'inclusions', always pass from the ladle to the tundish and there is also some tendency for the steel to pick up further impurities in the tundish.

It has generally been accepted that there is little scope for removing impurities from steel in a tundish although cover slags are of some use in this respect. Moreover, once the steel has passed from the tundish into the continuous casting mould, it is difficult to remove a significant proportion of impurities present despite the limited effect that may be achieved by use of suitable mould fluxes. In any event, inclusions in the steel in the tundish can be harmful as a result of being deposited in the bore of the outlet nozzles including any extension thereof below the tundish extending towards or into the moulds.

According to one aspect of the present invention a method of purifying steel comprises passing the steel through a tundish in which there is, between the zone of arrival of the steel in the tundish and the, or each, outlet from the tundish, at least one generally upright refractory board across the tundish, the board having a plurality of apertures through it through which the steel can pass, and introducing an inert gas into the steel at the foot of the board on the upstream side, whereby a stream of inert gas bubbles is caused to flow upwardly over the upstream side of the board.

The present invention is applicable whether or not the tundish is pre-heated and irrespective of the way in which the tundish is lined.

In the apertures through the board there may be ceramic filter elements as inserts supported in and by the structure of the refractory board. The filter elements may be of foam structure or have generally parallel courses through them as in a honey-comb structure. In this case the apertures are preferably relatively large, say of the order of 100 mm. or more in diameter. If the apertures do not have ceramic filter elements in them, they are preferably relatively small, say about 10 to about 30 mm in diameter. Alternatively, the refractory board may essentially consist of a ceramic filter element, the pores or cells of which providing the apertures. In this case the ceramic filter element may be within a frame of substantially non-porous refractory material.

If the board is to be used in a tundish which is not to be pre-heated, it is preferred that the otherwise exposed refractory material at the upstream side should carry a layer of exothermically reactive material. The presence of the exothermically reactive material reduces chilling of the steel by the board when the steel initially contacts the board.

Whilst the board is 'generally' upright, it may be advantageous for it to be slightly inclined e.g. at an angle of 5° from vertical with the upper edge more upstream than the lower edge. By inclining the board in this way one can aid ensuring that the bubbles sweep over the entire upstream face of the board.

In the method of the invention it is much preferred that the board should itself incorporate means for introducing inert gas into the steel at the lower part of the face of the board at the upstream side. Therefore, according to a further aspect of the invention a board, to be positioned generally upright in a tundish across the tundish, is of refractory material, has a plurality of apertures through it through which steel can pass and, at the lower part of one face, has a gas-permeable portion through which gas can pass outwardly and ducting for the supply of gas to the back of the gas-permeable portion.

The gas-permeable portion may be a portion of refractory material which is in itself of little or no gas-permeability but has a narrow slot or plurality of small holes in it through which gas can pass. The holes may have a diameter of, for example, about 0.5 mm. Alternatively, the gas-permeable portion may be of refractory material which itself is of high gas-permeability. The ducting to supply the gas may comprise a steel pipe embedded in the board, and with an access point at the top, and having at the lower part of the board one or more openings open to the back of the gas-permeable portion. By having the gas supply means integral with the board, the gas can be introduced just where it is most beneficial and without any need to modify the tundish itself. It is preferred that a number of the boards should be used in a tundish between the zone of arrival of the steel and an outlet from the tundish. It is particularly preferred that the more or most downstream board should comprise at least one ceramic filter element. Upstream of that board there is preferably one or more boards simply having apertures through them. Preferably there are at least two such boards and it is preferred that the size of the apertures in the more upstream of these boards should be larger than in the more downstream of these boards. Simply for ease of reference, hereafter the boards having ceramic filter elements in the apertures are termed filter boards whilst those with no such elements are termed collector boards. The apertures in the collector boards are larger than the pore or cell size of the filter elements.

The collector boards serve to collect a substantial proportion of inclusions in the steel, especially the larger inclusions. By introducing inert gas, preferably argon, into the steel at the foot of the boards at the upstream side the risk of partial or complete blockage of the apertures and filter pores or cells by inclusions can be minimised and inclusions swept up to a cover slag on top of the steel in the tundish and retained in the slag. The gas may be introduced continuously or intermittently according to need.

The apertures in the collector board preferably taper, being narrower at the upstream side than at the downstream side e.g. being generally frustoconical. This use of tapering apertures promotes efficient collection of inclusions without blockage of the apertures. Thus, according to a yet further aspect of the invention a board, to be positioned generally upright in a tundish across the tundish, is of refractory material and has a plurality of apertures through it, the apertures tapering from one side of the board to the other. This use of tapering apertures is advantageous irrespective of whether or not the board has an integral gas supply means and indeed irrespective of whether or not a gas supply is used at all as in the method of the invention as described above.

Irrespective of any other feature the collector board may possess and irrespective of the precise way in which it is used, it has been found in accordance with the invention that it is advantageous for the axes of the apertures through the boards to be at a non-perpendicular angle to the plane of the board. Thus, in accordance with yet another aspect of the invention a board, to be positioned generally upright in a tundish across a tundish is of refractory material and has a plurality of apertures through it, the axes of the apertures being at a non-perpendicular angle to the plane of the board. The axes of the apertures may deviate from perpendicular to the plane of the board by an angle of, for example, 5° to 30°.

By having the axes of the apertures angled as described above, the steel in the tundish may be caused to flow in a tortuous path and in accordance with the invention it has been found that this assists the removal of inclusions from the steel. Moreover, if the axes of the apertures are angled generally downwardly from the upstream face of the board to the downstream face in cases where gas is introduced into the steel at the face of the upstream side of the board, the angling of the axes of the apertures resists any tendency of the bubbles to pass through the apertures and it is advantageous to resist this tendency as passage of the bubbles through the apertures reduces effective sweeping of the upstream face of the board by the bubbles.

The invention is especially valuable for the removal of alumina inclusions, commonly present in relatively large amounts in tudish steel. Use of the collector board or boards in addition to the board or boards having the filter elements and the use of the gas enables high proportions of inclusions to be removed and enables the system to function well for extended periods e.g. as desired in the case of sequence casting. The use of the collector board permits efficient removal of the smaller inclusions by the board having the filter elements without the filter elements becoming prematurely blocked.

To enhance the ability of the collector boards to remove alumina inclusions from tundish steel, it is preferred that the walls defining the apertures should have a coating of high alumina content material or should have sleeve-like inserts of high alumina content material.

The invention is further described with reference to the accompanying drawings in which:

FIG. 3 is an enlarged view of the downstream face of another of the boards schematically indicated in FIG. 1;

FIG. 4 is a vertical section of the board of FIG. 3; and

FIG. 5 is a view of the upstream face of the board of FIG. 3.

Figure 1:
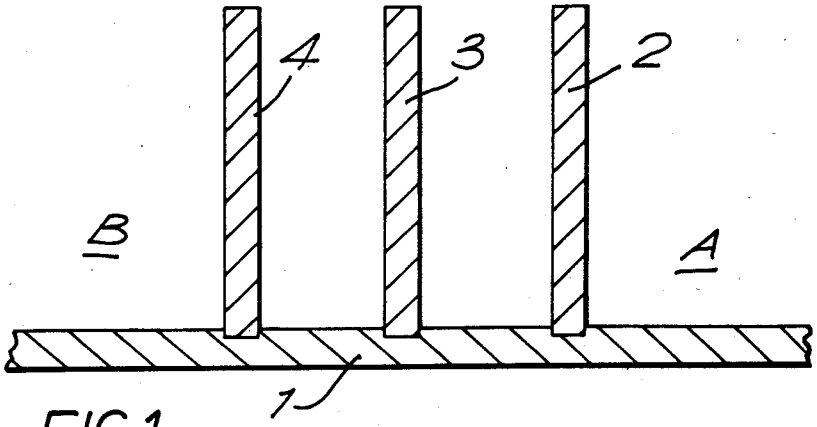
FIG. 1 is a schematic vertical section along the length of part of a tundish equipped in accordance with the invention.

Referring now to FIG. 1, in a tundish having a base 1 are three boards 2, 3 and 4 extending across the width of the tundish to a height slightly higher than the expected top surface level of the contents of the tundish. In relation to the general direction of flow of steel through the tundish, A signifies the upstream side i.e. the side nearer the zone of entry of steel into the tundish and B the downstream side i.e. the side nearer an outlet nozzle from the tundish.

Figure 2:
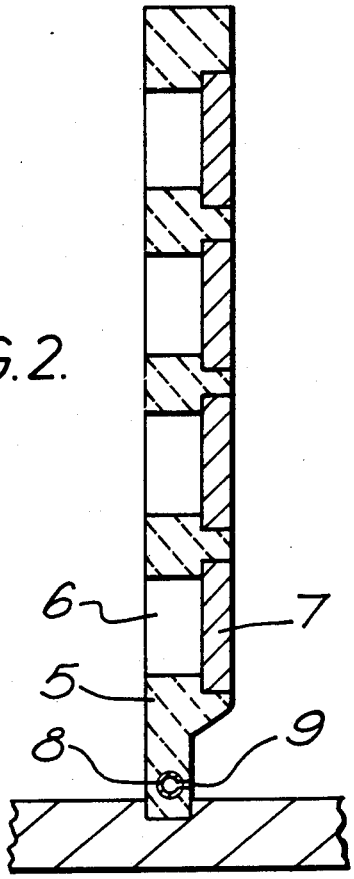
FIG. 2 is an enlarged vertical section through one of the boards schematically indicated in FIG. 1.

The board 4 indicated only schematically in FIG. 1 is a filter board having the structure shown in FIG. 2. Thus the board has a refractory structure 5 through which is a plurality of cylindrical apertures 6 each having a wider and a narrower part. Fixed in the wider part of each aperture 6 is a cylindrical cellular ceramic filter 7 of a generally honeycomb-like structure but in which the cells are of square section. Suitably the filter has about 264 cells per square inch of its face surface.

In the lower part of the refractory structure 5 is embedded a gas supply pipe 8 having a plurality of apertures each communicating with a passage 9 open at the upstream face of the board. The gas supply pipe has a continuation (not shown) embedded in the side of the board and extending to the top of the board where there is an access point to it. The positioning of the continuation of the gas supply pipe is similar to that shown in FIGS. 3, 4 and 5 relating to the board 3.

Referring now to FIGS. 3, 4 and 5, the board 3 has a refractory structure through which is a plurality of frustoconical apertures 10. At the downstream side (FIG. 3) the apertures are 1 inch in diameter whilst at the upstream side (FIG. 5) the diameter is 0.375 inches. Embedded in the board is a gas supply pipe 11 with continuation 12. The pipe 11 has at the upstream side (FIG. 5) a plurality of apertures communicating with the upstream face of the board via passages 13 having a diameter of about 0.02 inches.

The board 2 shown schematically in FIG. 1 is not shown in a more detailed Figure as it is generally the same as the board 3 except that at its downstream side the diameter of the apertures 10 through the board is about 1.25 inches and the diameter at the upstream side about 0.625 inches. The number of apertures 10 through the board 2 is correspondingly less than through the board 3.

In use, as steel flows through the tundish from the arrival zone towards the outlet, it passes successively through the boards 2, 3 and 4 and the larger inclusions, particularly alumina, are retained chiefly by the earlier board or boards whilst the smaller inclusions are retained by the later board or boards. In each of the boards inert gas e.g. argon is supplied continuously or intermittently to the gas supply pipe and bubbles ascend through the steel and sweep across the upstream face of each board thereby tending to carry inclusions into slag on top of the steel surface and resisting blockage of the apertures through the boards and the cells of the board 4.

I claim:

1. A board of refractory material, to be positioned generally upright in a tundish across the tundish, having a plurality of apertures through it through which steel can pass and, at the lower part of one face, a gas-permeable portion through which gas can pass outwardly and ducting for the supply of gas to the back of the gas-permeable portion.

2. A board according to claim 1 in which the gas-permeable portion is of refractory material of low gas-permeability having at least on opening in it through which gas can pass.

3. A board according to claim 1 in which the gas-permeable portion is of refractory material of high gas-permeability.

4. A board according to claim 1 in which the ducting comprises a pipe embedded in the board, and with an access point at the top, and having at the lower part of the board at least one opening open to the back of the gas-permeable portion.

5. A board of refractory material, to be positioned generally upright in a tundish across the tundish, having aplurality of apertures through it through which steel can pass, the apertures tapering from one side of the board to the other.

6. A board of refractory material, to be positioned generally upright in a tundish across the tundish, having a plurality of apertures through it through which steel can pass, the axes of the apertures being at a non-perpendicular angle to the plane of the board.

7. A board according to claim 6 in which the axes of the apertures deviate by from 5° to 30° from perpendicular to the plane of the board.

8. A board of refractory material, to be positioned generally upright in a tundish across the tundish, having a plurality of apertures through it through which steel can pass, the walls defining the apertures comprising a high alumina content material.

9. A board as recited in claim 2 wherein said at least one opening comprises a slot.

10. A board as recited in claim 2 wherein said at least one opening comprises a plurality of holes.

11. A board as recited in claim 8 wherein the walls defining the apertures have a coating of high alumina content material.

12. A board as recited in claim 8 wherein the walls defining the apertures have sleeve-like inserts of high alumina content material.

13. A tundish for use in the teeming of molten metals having a generally horizontally extending base, and a width; and a board of refractory material positioned generally upright in the tundish, across the width of the tundish, said board having a plurality of apertures through it through which steel can pass, the axes of the apertures beign at a non-perpendicular angle to the plane of the board.

14. A board according to claim 13 in which the axes of the apertures deviate by from 5°–30° from perpendicular to the plane of the board.

15. Apparatus as recited in claim 13 further comprising walls defining the apertures having a high alumina content.

16. Apparatus as recited in claim 13 wherein the board is slightly inclined with respect to the vertical, disposed at an angle of about 5° from the vertical.

17. A tundish for use in the teeming of molten metals having a generally horizontally extending base, and a width; and a board of refractory material positioned generally upright in the tundish, across the width of the tundish, said board having a plurality of apertures through it through which steel can pass, said board having at the lower part of one face a gas-permeable portion through which gas can pass outwardly, and ducting for the supply of gas to the back of the gas-permeable portion.

18. Apparatus as recited in claim 17 wherein said gas-permeable portion is of refractory material of low gas-permeability having at least on opening in it through which gas can pass.

19. Apparatus as recited in claim 17 wherein said gas-permeable portion is of refractory material of high gas-permeability.

20. Apparatus as recited in claim 17 wherein the ducting comprises a pipe imbedded in the board, with an access point at the top, and having at the lower part of the board at least one opening open to the back of the gas permeable portion.

* * * * *